US009089169B1

(12) United States Patent
Covo et al.

(10) Patent No.: US 9,089,169 B1
(45) Date of Patent: Jul. 28, 2015

(54) GARMENT APPARATUS FOR INTERACTIVE ENGAGEMENT WITH CHILDREN OR PETS

(71) Applicants: Olga C. Covo, Lynbrook, NY (US); Eric M. Covo, Lynbrook, NY (US)

(72) Inventors: Olga C. Covo, Lynbrook, NY (US); Eric M. Covo, Lynbrook, NY (US)

( * ) Notice: Subject to any disclaimer, the term of this patent is extended or adjusted under 35 U.S.C. 154(b) by 0 days.

(21) Appl. No.: 14/067,666

(22) Filed: Oct. 30, 2013

(51) Int. Cl.
*A41B 1/00* (2006.01)
*A41B 1/08* (2006.01)

(52) U.S. Cl.
CPC ..... *A41B 1/08* (2013.01)

(58) Field of Classification Search
CPC ..... A41D 27/08; A41D 27/085; A41D 27/20; A41D 27/201; A41D 27/101; A41D 2300/00; A41D 2300/30; A41D 2300/32; A41D 2300/322; A41D 2300/324; A41D 2300/326; A41D 2300/328; A41D 2300/33; A41D 2300/332; A41D 11/00; A41D 1/00; A41D 1/18; A41D 13/0012; A41D 27/202; A41B 1/00; A41B 1/08; A41B 1/18
USPC ..... 2/69, 113–115, 105, 106, 244, 246, 2/247–251, 102, 85, 96, 94, 83, 80, 1; 40/586
See application file for complete search history.

(56) References Cited

U.S. PATENT DOCUMENTS

| | | | | |
|---|---|---|---|---|
| 4,661,072 | A * | 4/1987 | White | 434/260 |
| 4,710,979 | A * | 12/1987 | Bull et al. | 2/48 |
| 6,694,520 | B2 * | 2/2004 | Smith | 2/48 |
| 7,013,493 | B2 * | 3/2006 | Briscoe et al. | 2/247 |
| 7,086,121 | B2 | 8/2006 | Lippincott | |
| 7,117,824 | B2 | 10/2006 | Holtzworth et al. | |
| 8,387,284 | B2 | 3/2013 | Baum | |
| 2012/0214013 | A1 | 8/2012 | Namsaraeva | |
| 2012/0329357 | A1 | 12/2012 | Brodess | |
| 2012/0329361 | A1 | 12/2012 | Buckley | |

* cited by examiner

*Primary Examiner* — Gloria Hale
(74) *Attorney, Agent, or Firm* — Richard L. Miller

(57) ABSTRACT

A garment for allowing a caretaker to engage and entertain a user which has an article of clothing which has toys attached thereon by releasable attachment devices. The releasable attachment devices engage fixed attachment points on the article of clothing. Further, the article of clothing has attached thereon an interactive engagement device for entertaining a user by providing means to open and close the device or sub-elements thereof.

14 Claims, 5 Drawing Sheets

GARMENT APPARATUS FOR INTERACTIVE ENGAGEMENT WITH CHILDREN OR PETS

BACKGROUND OF THE INVENTION

1. Field of the Invention

The present invention relates to an interactive garment, and more particularly, a GARMENT APPARATUS FOR INTERACTIVE ENGAGEMENT WITH CHILDREN OR PETS.

2. Description of the Prior Art

Numerous innovations for garments have been provided in the prior art that will be described. Even though these innovations may be suitable for the specific individual purposes to which they address, however, they differ from the present invention.

A FIRST EXAMPLE, U.S. Patent Office Document No. 7,013,493, Published/Issued on Mar. 21, 2006, to Briscoe, et al. teaches an article of clothing designed to also function as a traveling entertainment center, preferably for a child. The clothing may be reversible with at least one pocket, preferably eight total pockets, four on each side. Toy attachment straps can be buttoned onto each clothing front side. A hidden button system means the strap is on the outside accessible by the child, but the button attachment is on the inside of the clothing hidden under a pocket. This keeps the strap safe and secure. The bottom of each strap has a fastener loop, preferably Velcro. This strap design allows for adding and removing toys manufactured for the clothing, as well as the user's own toys, including pacifiers, rattles and rings. The fastener loop is easily opened and closed to remove and secure toys. The back of the clothing may include a flap-covered loop for attaching a child-leash system. Thus a considerably more versatile article of clothing is provided that can be converted into an entertainment center that travels with the wearer.

A SECOND EXAMPLE, U.S. Patent Office Document No. 7,086,121, Published/Issued on Aug. 8, 2006, to Lippincott teaches a non-removable snap fastener used to attach a pacifier, teething ring, toy or other article to any garment of children's clothing. It is comprised of a non-removable female part of a snap fastener, which is attached to any garment of children's clothing, and preferably, though not necessary for effectiveness, incorporated into a decoration of flowers, animals, toys or any other attractive decoration for any garment of children's clothing, created using embroidery, applique, needlepoint or other craft. The corresponding male part of the snap fastener is attached to one end of a strap, having both female and male parts of a snap fastener attached to the other end of the strap, which is used to secure the article onto the strap for the child's use. It is unique in being a safe, effective and attractive means for providing a child with ready access to articles that aid in fulfilling the sucking need of children, providing uninterrupted sleep, relieving the pain of teething and providing amusement and interest for the child.

A THIRD EXAMPLE, U.S. Patent Office Document No. 7,117,824, Published/Issued on Oct. 10, 2006, to Holtzworth, et al. teaches a garment for the transporting, observing, entertaining, training, and displaying of small animals, reptiles and insects (gerbils, mice, snakes, tarantulas, spiders, lizards, etc.) in the tunnels of the garment while on the shoulders of their owners. The garment consists of a see-through, mesh washable fabric panel on top and a brightly colored washable panel underneath, attached to each other using releasable fasteners. The fasteners also provide means to construct tunnel walls and nesting areas for the small animal. The fasteners further provide attachment to the garment tunnel's floor and walls for toys and other paraphernalia to entertain the pet and adorn the garment. This garment allows the owner to hold, observe, and transport his pet without damaging or soiling his clothes while his pet has a tunnel in which to play and rest safely. Also the owner can remove toys, food and nesting material in order to launder the garment.

A FOURTH EXAMPLE, U.S. Patent Office Document No. 8,387,284, Published/Issued on Mar. 5, 2013, to Baum teaches a method for providing changeable designs on clothing such as shoes by integrating a portion of the outer surface of an existing article of the shoe with a base anchor, and a system therefor. A selected ornamentation is placed on the shoe at the site of the base anchor. The ornamentation is integrated with an attachment for cooperative releasable fastening engagement with the anchor. The ornamentation is releasably fastened to the outer surface of the shoe by engaging the base anchor with the attachment of the ornamentation. The attachment and the base anchor provide the fastening of the ornamentation to the outer surface of the shoe substantially without intervening fastening elements, between the ends of the ornamentation and the outer surface of the shoe, which space the peripheral ends from the shoe. The engaging between the base anchor with the ornamentation is positioned as not being externally visible.

A FIFTH EXAMPLE, U.S. Patent Office Document No. 20120214013, Published/Issued on Aug. 23, 2012, to Namsaraeva teaches an interchangeable and detachable accessory addition to clothing accessories, handbags, shoes, and apparel provides a wide variety of fashionable and easily interchangeable looks. This helps keep the wardrobe compact while at the same time providing a wide variety of fashionable looks. Interchangeable and detachable accessory addition does not tear at clothing, can be easily removed, mixed and matched with ease for the busy Fashionistas on the go.

A SIXTH EXAMPLE, U.S. Patent Office Document No. 20120329357, Published/Issued on Dec. 27, 2012, to Brodess teaches a novelty garment having an ornamental and entertaining feature, particularly a plush toy as a part thereof. The garment has two different embodiments. The first embodiment is worn as a sleeve on a human arm. The second embodiment is worn as a band on any part of the arm.

A SEVENTH EXAMPLE, U.S. Patent Office Document No. 20120329361, Published/Issued on Dec. 27, 2012, to Buckley teaches a detachable garment or accessory for a toy. The garment or accessory includes at least a first front part and a second rear part movable relative to each other via pivot or hinge means on or associated with the parts between an open position, wherein the garment or accessory can be attached to or removed from at least part of the toy, and a closed position, wherein the garment or accessory can be secured to the toy. Each part includes a top edge, a base edge and lateral edges. The pivot or hinge provided between one or more of the lateral edges of the front and rear parts allow at least a portion of the lateral edges of the parts to be separated to form the open position and moved towards each other to form the closed position.

It is apparent now that numerous innovations for interactive garments have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a GARMENT APPARATUS FOR INTERACTIVE ENGAGEMENT WITH CHILDREN OR PETS that avoids the disadvantages of the prior art.

ANOTHER OBJECT of the present invention is to provide a GARMENT APPARATUS FOR INTERACTIVE ENGAGEMENT WITH CHILDREN OR PETS that is simple and inexpensive to manufacture.

STILL ANOTHER OBJECT of the present invention is to provide a GARMENT APPARATUS FOR INTERACTIVE ENGAGEMENT WITH CHILDREN OR PETS that is simple to use.

BRIEFLY STATED, STILL YET ANOTHER OBJECT of the present invention is to provide a GARMENT APPARATUS FOR INTERACTIVE ENGAGEMENT WITH CHILDREN OR PETS that allows a caretaker to distract or engage a user without having that user pull on jewelry, hair or other body parts as is often currently the case.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
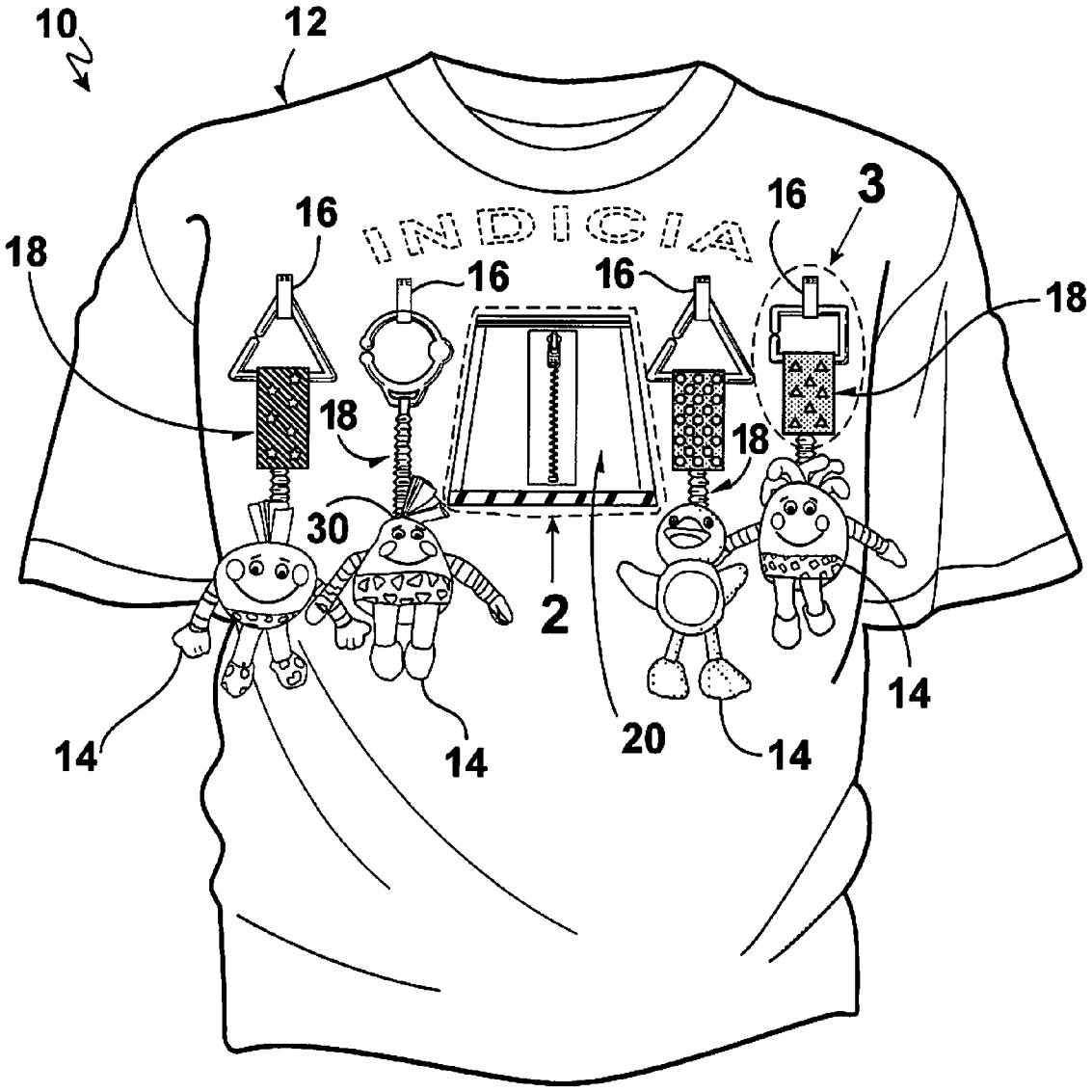
FIG. 1 is a diagrammatic front elevational view of a first embodiment of the garment of the present invention.

10 garment for providing entertainment to a user
12 article of clothing
14 plurality of toys
16 plurality of loop attachment points
18 plurality of attachment devices
20 interactive engagement device
22 slitted ring
24 elasticated cord
26 openable loop
28 top end of elasticated cord 24
30 bottom end of elasticated cord 24
32 hook and loop pile fastener of openable loop 26
34 base of interactive engagement device 20
36 first flap of interactive engagement device 20
38 second flap of interactive engagement device 20
40 closure of interactive engagement device 20
42 at least one edge of first flap 36 of interactive engagement device 20
44 at least one edge of second flap 38 of interactive engagement device 20
46 inner surface of first flap 36 of interactive engagement device 20
48 inner surface of second flap 38 of interactive engagement device 20
50 outer surface of first flap 36 of interactive engagement device 20
52 outer surface of second flap 38 of interactive engagement device 20
54 reflective material
56 fur material
58 openable tab of interactive engagement device 20
60 first portion of openable tab 58 of interactive engagement device 20
62 second portion of openable tab 58 of interactive engagement device 20
64 first pile material of openable tab 58 of interactive engagement device 20
66 second pile material of openable tab 58 of interactive engagement device 20
68 mechanical slide fastener closure 40 of interactive engagement device 20
70 first set of teeth of mechanical slide fastener 68 closure 40 of interactive engagement device 20
72 second set of teeth of mechanical slide fastener 68 closure 40 of interactive engagement device 20
74 straight edge of first flap 36 of interactive engagement device 20
76 straight edge of second flap 38 of interactive engagement device 20
78 trapezoidal base 34 of interactive engagement device 20
80 first side of trapezoidal 78 base 34 of interactive engagement device 20
82 second side of trapezoidal 78 base 34 of interactive engagement device 20
84 outside edge of first side 80 of trapezoidal 78 base 34 of interactive engagement device 20
86 outside edge of second side 82 of trapezoidal 78 base 34 of interactive engagement device 20
88 snap closure 40 of interactive engagement device 20
90 miniaturized piece of apparel of interactive engagement device 20

DETAILED DESCRIPTION OF THE PREFERRED EMBODIMENT

Referring now to the figures, in which like numerals indicate like parts, and particularly to FIG. 1, disclosed is garment 10 for providing entertainment to a user which comprises an article of clothing 12, a plurality of toys 14, a plurality of attachment points 16, and a plurality of attachment means 18, which attachment means 18 are attachment devices 18 having several parts. The article of clothing 12 is for wearing by a wearer, so as to allow the wearer to have the toys available for entertaining a user. The article of clothing 12 at least partially covers the wearer's torso, and in a preferred embodiment is a shirt.

The attachment points 16 are fixedly attached to the article of clothing 12 by sewing and in a preferred embodiment comprise loop attachment points 16. The plurality of toys 14, plurality of attachment points 16, and plurality of attachment devices 18 each correspond to one another, so that there are the same number of each.

The garment 10 in a preferred embodiment further comprises an interactive engagement device 20 for entertaining a user which is fixedly attached to the article of clothing 12.

Detailed Description of the Attachment Device

Figure 3:
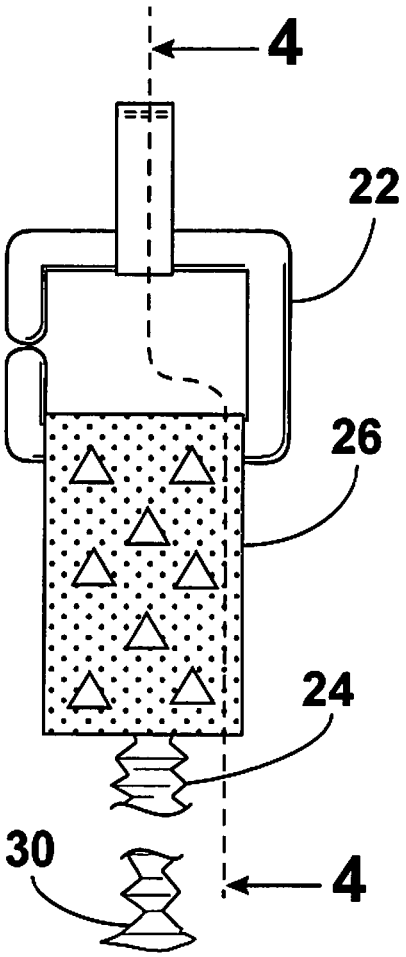
FIG. 3 is an enlarged diagrammatic elevational view of securement component enclosed in the dotted curve indicated by arrow 3 in FIG. 1.
Figure 4:
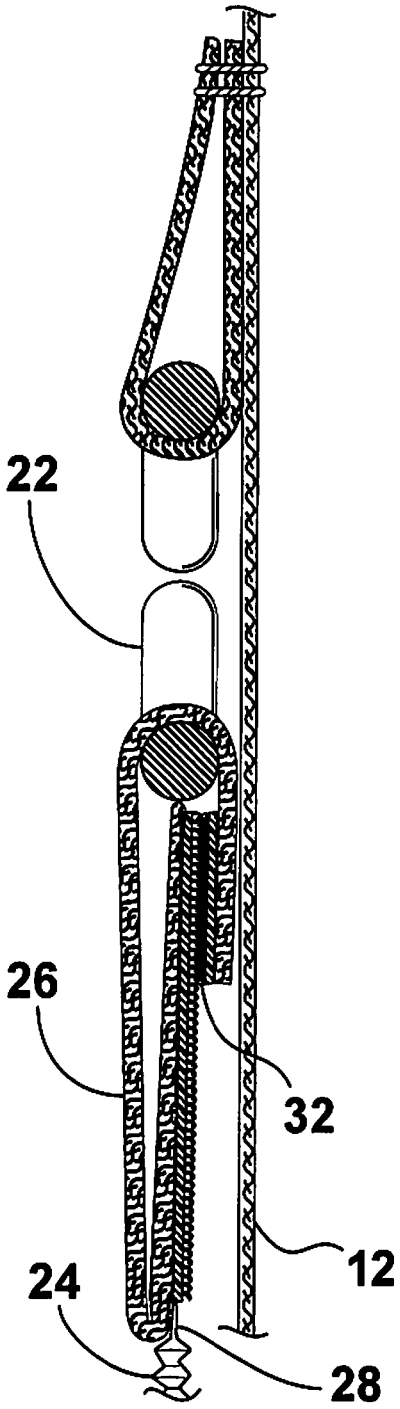
FIG. 4 is a cross sectional view taken along line 4-4 in FIG. 3.

As is illustrated in FIGS. 1, 3, and 4, the plurality of toys are removably attachable to said corresponding attachment points by the corresponding attachment devices. Each attachment device comprises:

a) a slitted ring 22;

b) an elasticated cord 24; and c) an openable loop 26.

The slitted ring 22 is for engaging the loop attachment points 16. It does this by the loop 16 being passed through the slit 22, with the slit being positioned to not easily allow escape when pulled by gravity.

The elasticated cord 24 has a top end 28 and a bottom end 30, and is for securing the toy 14 to the openable loop 26. This is accomplished by said top end 28 being secured to the openable loop 26, and the bottom end being secured to the corresponding toy.

The openable loop 26 is for connecting the elasticated cord 24 to the slitted ring 22, and may be of a thicker material than the loop attachment points, since being openable it can be inserted into the slitted ring without needing to fit through the slit thereof. In a preferred embodiment, the openable loop 26 is openable via a hook and loop pile fastener 32.

Detailed Description of the Interactive Engagement Device

Figure 2:
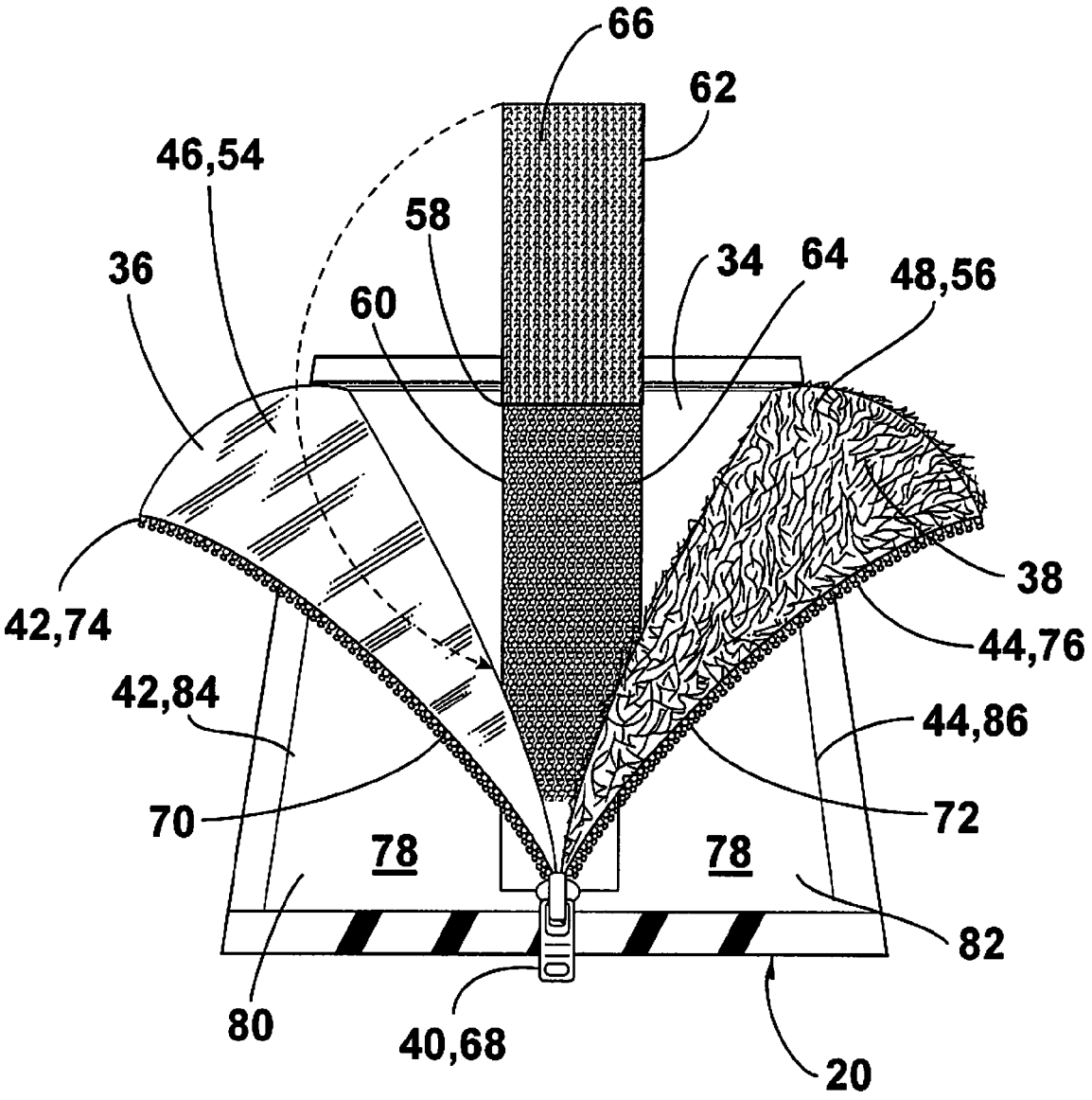
FIG. 2 is an enlarged diagrammatic elevational view of a trapezoidal shaped style pouch component enclosed in the dotted curve indicated by arrow 2 in FIG. 1 with a slide fastener placed in an open position so as to reveal different materials otherwise concealed therein.
Figure 6:
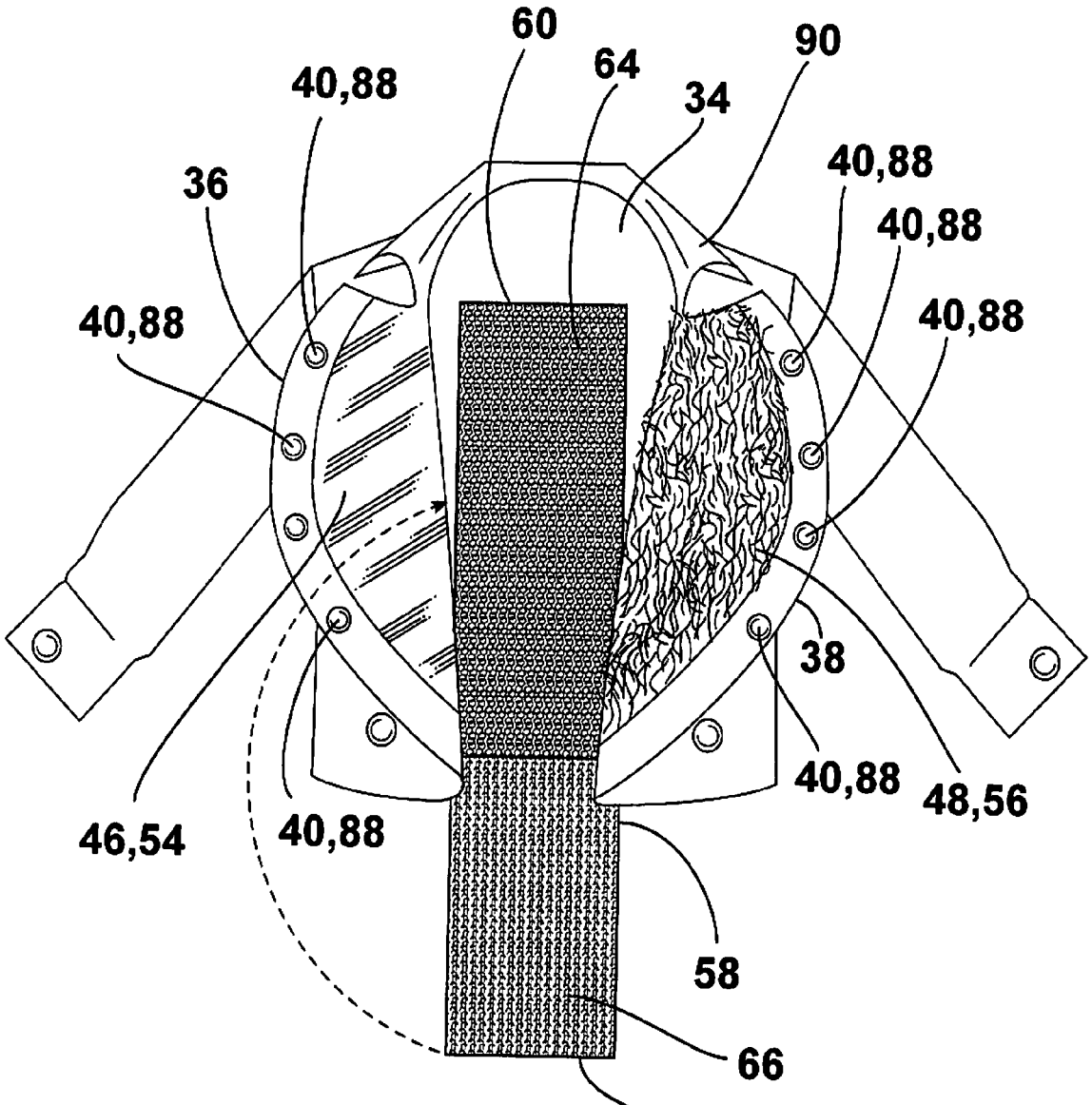
FIG. 6 is an enlarged diagrammatic elevational view of a shirt shaped style pouch component enclosed in the dotted curve indicated by arrow 6 in FIG. 1 with a set of snap fasteners separated from each other so as to reveal different materials otherwise concealed therein.

Referring now to FIGS. 1, 2, and 6, the interactive engagement device 20 comprises:

a) a base 34;

b) a first flap 36;

c) a second flap 38; and d) a closure 40;

The base 34 is for fixedly attaching the interactive engagement device 20 to the article of clothing 12. Both the first flap 36 and the second flap 38 have at least one edge 42,44, but in most embodiments at least two edges. A one-edge embodiment is only possible where the flaps are entirely curved and have no corners, otherwise most configurations will have more than one edge. If all edges are not curved, then the minimum number of geometrically possible edges is three.

At least part of at least one edge of each flap 42,44 is fixedly attached to the base, preferably by sewing but any well known attachment means such as glue or heat sealing may be used as well. The closure 40 is for securing the two flaps together releasably so that they can be opened and closed for the entertainment of the user.

The first and second flaps 36,38 both comprise inner surfaces 46,48 and outer surfaces 50,52. The inner surfaces 46,48 have materials 54,56 on them for the entertainment of the user, so that when the user opens the flap those materials 54,56 are exposed. While any materials may be used for this, the preferred use is materials that have distinctive visual or textural properties such as reflective materials 54, holographic materials, fur materials 56, rough materials, or silken materials.

In a preferred construction, the interactive engagement device further comprises an openable tab 58. The openable tab 58 comprises a piece of material having a first portion 60 and a second portion 62. The first portion 60 is fixedly attached to the base 34 of the interactive engagement device 20 underneath the flaps 36,38 thereof. The second portion 62 extends from the first portion and may hang loosely therefrom.

The first portion of the openable tab comprises a first pile material 64, and the second portion of the openable tab comprises a second pile material 66. These materials cooperate with one another to allow the tab 58 to be openable. The materials in a preferred construction comprise a hook pile material and a loop pile material, but other pile materials may be used, for example hermaphroditic pile materials.

Detailed Description of the Different Embodiments of the Interactive Engagement Device The above description is generic to the two embodiments of the interactive engagement device disclosed. Now, referring specifically to FIG. 2, the first of the two embodiments will be described with regard to the details which distinguish it from the second embodiment.

In the first embodiment, the closure 40 of the interactive engagement device 20 comprises a mechanical slide fastener 68 closure. The mechanical slide fastener 68 comprises a first set of teeth 70 and a second set of teeth 72. The first set of teeth is mounted along an edge 42,74 of the first flap 36, and the second set of teeth is attached to an edge 44,76 of the second flap 38. To accomplish this, the edges of the first flap 36 and the second flap 38 where the teeth are attached are straight. Accordingly, the flaps must have at least two edges, since it is geometrically impossible for a shape to have less than two edges if one of the edges is straight.

In the first embodiment, the base 34 comprises a substantially trapezoidal base 78, having a first side 80 and a second side 82, which first side and second side are in essence the left and right sides of the trapezoidal base 78. The first 80 and second 82 sides both have outside edges 84,86. The first flap 36 is fixedly attached to the outside edge 84 of the first side 80, and the second flap 38 is fixedly attached to the outside edge of the second side. In this way, when they are secured together by the mechanical slide fastener 68, they cover the center of the trapezoid.

Figure 5:
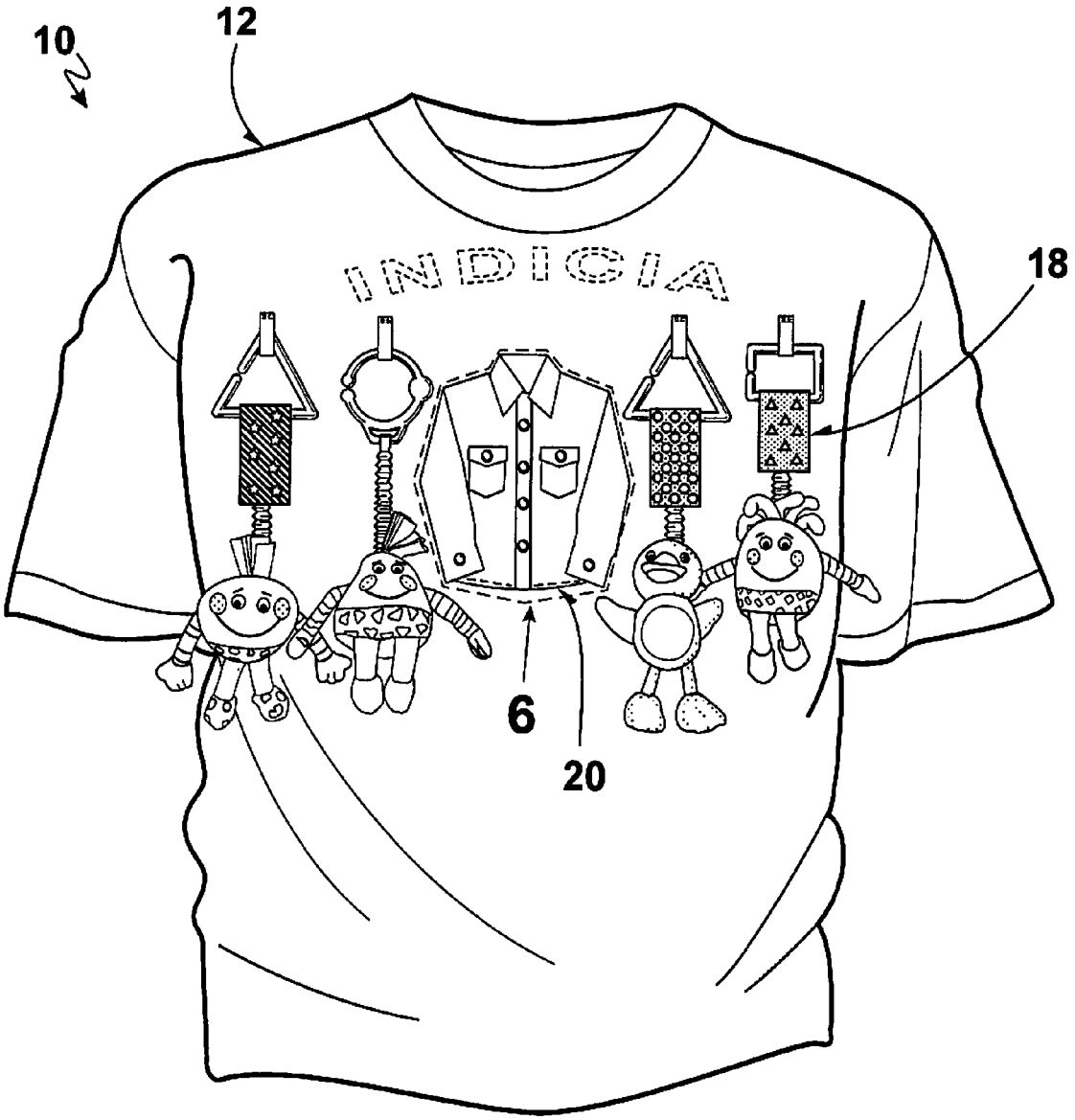
FIG. 5 is a diagrammatic front elevational view of a second embodiment of the garment of the present invention.

In the second embodiment which is shown in FIGS. 5 and 6 instead of a mechanical slide fastener closure 68, snap closures 88 are used to connect the first flap to the second flap. The snaps 88 in the second embodiment permit the interactive engagement device to have the appearance of a piece of apparel, and to comprise a miniaturized version 90 thereof. In a preferred construction, the miniaturized piece of apparel is a miniaturized shirt.

General Summation

It will be understood that each of the elements described above, or two or more together, may also find a useful application in other types of constructions differing from the types described above.

While the invention has been illustrated and described as embodiments of a GARMENT APPARATUS FOR INTERACTIVE ENGAGEMENT WITH CHILDREN OR PETS, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A garment for providing entertainment to a user which comprises:

a) an article of clothing;

b) a plurality of toys;

c) a plurality of attachment points; and d) a plurality of attachment means;

wherein said article of clothing is for wearing by a wearer;

wherein said article of clothing at least partially covers a torso of the wearer;

wherein said plurality of attachment points are fixedly attached to said article of clothing;

wherein said plurality of toys, said plurality of attachment points, and said plurality of attachment means each correspond to one another;

wherein said plurality of toys are removably attachable to said corresponding attachment points by said corresponding attachment means;

wherein said plurality of toys are for entertaining a user;

wherein said attachment points are fixedly attached to said article of clothing by sewing;

wherein said plurality of attachment points comprise loop attachment points;

wherein said garment further comprises an interactive engagement device;

wherein said interactive engagement device is fixedly attached to said article of clothing;

wherein said interactive engagement device is for entertaining a user;

wherein said interactive engagement device comprises:

a) a base;

b) first flap;

c) a second flap; and d) a closure means;

wherein said base is for fixedly attaching said interactive engagement device to said article of clothing;

wherein said first flap has at least one edge;

wherein at least part of said at least one edge of said first flap is fixedly attached to said base;

wherein said second flap has at least one edge;

wherein at least part of said at least one edge of said second flap is fixedly attached to said base;

wherein said closure means releasably attaches said first flap and said second flap;

wherein said first flap comprises an inner surface and an outer surface;

wherein said second flap comprises an inner surface and an outer surface;

wherein said inner surface of said first flap comprises a first material; and wherein said inner surface of said second flap comprises a second material;

wherein said first material comprises a reflective material.

2. The garment of claim 1 wherein said second material comprises a fur material.

3. The garment of claim 1 wherein said interactive engagement device further comprises an openable tab;

wherein said openable tab comprises a piece of material having a first portion and a second portion;

wherein said first portion of said material is fixedly attached to said base of said interactive engagement device;

wherein said first portion comprises a first pile fastener material;

wherein said second portion comprises a second pile fastener material which cooperates with said first pile fastener material; and wherein said cooperation between said first pile fastener and said second pile fastener is for making said openable tab openable.

4. The garment of claim 3 wherein said first flap comprises an inner surface and an outer surface;

wherein said second flap comprises an inner surface and an outer surface;

wherein said inner surface of said first flap comprises a first material;

wherein said inner surface of said second flap comprises a second material;

wherein said first material comprises a reflective material; and wherein said second material comprises a fur material.

5. The garment of claim 4 wherein said closure means of said interactive engagement device comprises a mechanical slide fastener;

wherein said mechanical slide fastener comprises a first set of teeth and a second set of teeth;

wherein said first flap of said interactive engagement device has at least two edges;

wherein at least one of said at least two edges of said first flap of said interactive engagement device is a straight edge;

wherein said first set of teeth is mounted along said at least one straight edge of said first flap;

wherein said second flap of said interactive engagement device has at least two edges;

wherein at least one of said at least two edges of said second flap of said interactive engagement device is a straight edge; and wherein said second set of teeth of said mechanical slide fastener is mounted along said at least one straight edge of said second flap.

6. The garment of claim 5 wherein said base comprises a substantially trapezoidal base.

7. The garment of claim 6 wherein said substantially trapezoidal base has a first side and a second side;

wherein said first side has an outside edge;

wherein said second side has an outside edge;

wherein one edge of said first flap is fixedly attached to said outside edge of said first side; and wherein said one edge of said second flap is fixedly attached to said outside edge of said second side.

8. The garment of claim 4 wherein said closure means of said interactive engagement device comprises snaps.

9. The garment of claim 8 wherein said interactive engagement device comprises a miniaturized piece of apparel.

10. The garment of claim 9 wherein said miniaturized piece of apparel is a miniaturized shirt.

11. A garment for providing entertainment to a user which comprises:

a) an article of clothing;

b) a plurality of toys;

c) a plurality of attachment points; and d) a plurality of attachment means;

wherein said article of clothing is for wearing by a wearer;

wherein said article of clothing at least partially covers a torso of the wearer;

wherein said plurality of attachment points are fixedly attached to said article of clothing;

wherein said plurality of toys, said plurality of attachment points, and said plurality of attachment means each correspond to one another;

wherein said plurality of toys are removably attachable to said corresponding attachment points by said corresponding attachment means;

wherein said plurality of toys are for entertaining a user;

wherein said attachment points are fixedly attached to said article of clothing by sewing;

wherein said plurality of attachment points comprise loop attachment points;

wherein said attachment means comprises a slitted ring attachment means; and wherein said slitted ring attachment means is for engaging said loop attachment points.

12. The garment of claim 11 wherein said attachment means further comprises an elasticated cord;

wherein said elasticated cord has a top end and a bottom end;

wherein said bottom end of said elasticated cord is secured to one of said plurality of toys.

13. The garment of claim 12 wherein said attachment means further comprises an openable loop;

wherein said openable loop is for connecting said top of said elasticated cord to said slitted ring; and wherein said top end of said elasticated cord is for securing to said openable loop, so that said elasticated cord connects said toy to said openable loop.

14. The garment of claim 13 wherein said openable loop comprises a hook and loop pile fastener openable element.

* * * * *